US011293163B2

(12) United States Patent
Nogi et al.

(10) Patent No.: US 11,293,163 B2
(45) Date of Patent: Apr. 5, 2022

(54) HYDRAULIC DRIVE DEVICE FOR EXCAVATION WORK MACHINES

(71) Applicants: Kobe Steel, Ltd., Kobe (JP); KOBELCO CONSTRUCTION MACHINERY CO., LTD., Hiroshima (JP)

(72) Inventors: Toshihiro Nogi, Kobe (JP); Satoshi Maekawa, Kobe (JP); Akira Tsutsui, Kobe (JP); Sho Fujiwara, Hiroshima (JP)

(73) Assignees: Kobe Steel, Ltd., Kobe (JP); KOBELCO CONSTRUCTION MACHINERY CO., LTD., Hiroshima (JP)

( * ) Notice: Subject to any disclaimer, the term of this patent is extended or adjusted under 35 U.S.C. 154(b) by 0 days.

(21) Appl. No.: 17/265,977

(22) PCT Filed: Jul. 24, 2019

(86) PCT No.: PCT/JP2019/029038
§ 371 (c)(1),
(2) Date: Feb. 4, 2021

(87) PCT Pub. No.: WO2020/039833
PCT Pub. Date: Feb. 27, 2020

(65) Prior Publication Data

US 2021/0301492 A1 Sep. 30, 2021

(30) Foreign Application Priority Data

Aug. 23, 2018 (JP) ..... JP2018-156095

(51) Int. Cl.
*E02F 3/42* (2006.01)
*E02F 3/43* (2006.01)
(Continued)

(52) U.S. Cl.
CPC ..... *E02F 3/425* (2013.01); *E02F 3/435* (2013.01); *E02F 9/2228* (2013.01);
(Continued)

(58) Field of Classification Search
CPC . E02F 3/425; E02F 3/437; E02F 9/265; E02F 9/2285; E02F 9/2235; E02F 9/2282; F15B 13/0403; F15B 2211/3058
See application file for complete search history.

(56) References Cited

U.S. PATENT DOCUMENTS 5,826,666 A * 10/1998 Tozawa ..... E02F 3/437 172/7
5,975,214 A 11/1999 Okamura et al.
(Continued)

FOREIGN PATENT DOCUMENTS

JP 5-321297 A 12/1993
JP 9-228404 A 9/1997
(Continued)

OTHER PUBLICATIONS

Extended European Search Report dated Sep. 8, 2021 in corresponding European Patent Application No. 19852829.1, 9 pages.
(Continued)

*Primary Examiner* — Abiy Teka
(74) *Attorney, Agent, or Firm* — Oblon, McClelland, Maier & Neustadt, L.L.P.

(57) ABSTRACT

A hydraulic drive apparatus includes a boom flow rate control valve, a target boom cylinder speed calculation part, a pressing force calculation part, a correction part, and a boom flow rate operation part. The target boom cylinder speed calculation part calculates a target boom cylinder speed for making the construction surface by the bucket closer to the target construction surface. The pressing force calculation part calculates the pressing force by which the
(Continued)

bucket is pressed against the construction surface, based on the cylinder thrust of the boom cylinder and the center-of-gravity position information on the center-of-gravity position of the work device. The correction part corrects the target boom cylinder speed to make the deviation between the target pressing force and the calculated pressing force closer to 0. The boom flow rate operation part operates the boom flow rate control valve to provide the corrected target boom cylinder speed.

5 Claims, 6 Drawing Sheets

(51) Int. Cl.
*E02F 9/22* (2006.01)
*F15B 15/20* (2006.01)
*E02F 3/32* (2006.01)

(52) U.S. Cl.
CPC ..... *E02F 9/2267* (2013.01); *E02F 9/2271* (2013.01); *E02F 9/2285* (2013.01); *F15B 15/202* (2013.01); *E02F 3/32* (2013.01); *E02F 9/2292* (2013.01); *E02F 9/2296* (2013.01)

(56) References Cited

U.S. PATENT DOCUMENTS 6,108,948 A * 8/2000 Tozawa ..... E02F 3/435 37/348
2015/0039189 A1* 2/2015 Wu ..... E02F 9/2075 701/50
2016/0251836 A1* 9/2016 Baba ..... E02F 9/123 701/50
2016/0281331 A1 9/2016 Ikegami et al.
2017/0089033 A1* 3/2017 Matsuyama ..... E02F 3/437
2017/0145662 A1 5/2017 Iwasaki et al.
2017/0183842 A1* 6/2017 Yamashita ..... E02F 3/425
2018/0172037 A1 6/2018 Cugati et al.
2018/0230671 A1 8/2018 Wu
2019/0226181 A1 7/2019 Imura et al.

FOREIGN PATENT DOCUMENTS

JP 10-219727 A 8/1998
JP 2018-53675 A 4/2018
WO WO 2016/056678 A1 4/2016
WO WO 2016/169939 A1 10/2016
WO 2016-205495 A 12/2016
WO WO 2018/051511 A1 3/2018
WO WO 2018/092533 A1 5/2018

OTHER PUBLICATIONS

International Search Report dated Aug. 20, 2019 in PCT/JP2019/029038 filed Jul. 24, 2019, 2 pages.

* cited by examiner

HYDRAULIC DRIVE DEVICE FOR EXCAVATION WORK MACHINES

TECHNICAL FIELD

The present invention is related to an apparatus installed in an excavation work machine equipped with an excavation device including a boom, arm and bucket to hydraulically drive the excavation device.

BACKGROUND ART

An excavation work machine, such as a hydraulic excavator, typically has an excavation device including a raiseable and lowerable boom, an arm coupled to the tip of the boom so as to be rotationally movable, and a bucket attached to the tip of the arm. A typical apparatus for hydraulically driving such an excavation device includes a hydraulic pump, a plurality of hydraulic cylinders connected to the hydraulic pump, and a plurality of control valves. The plurality of hydraulic cylinders include a boom cylinder for driving the boom, an arm cylinder for drive the arm and a bucket cylinder for driving the bucket. The plurality of control valves are connected to the boom cylinder, the arm cylinder and the bucket cylinder, respectively. Each of the control valves is formed of, for example, a pilot operated selector valve, operated to open to change the direction and the flow rate of the supply of hydraulic fluid to the hydraulic actuator that corresponds to the control valve, in response to the pilot pressure that is input to the control valve.

Furthermore, in recent years, to reduce the burden on the operator, the development has been advanced on a hydraulic drive apparatus having an automatic control function of controlling the driving of the boom and the arm of the work device so as to allow an operator to move the bucket along a preset target locus only through a simple operation.

For example, Patent Literature 1 discloses a hydraulic drive apparatus installed on a hydraulic excavator provided with a boom, an arm, which is called "stick" in Patent Literature 1, and a bucket. The hydraulic drive apparatus is configured to calculate a target position and a target speed of each of the hydraulic cylinders so as to move the cutting edge of the bucket along a target locus in response to the operation applied to the arm operation lever, namely, a stick operation lever in Patent Literature 1, and control the speed.

Furthermore, Patent Literature 1 discloses multiplying the load pressure of the boom cylinder by the substantial pressure receiving area in the cylinder to thereby calculate a compaction force and automatically adjusting the height position of the bucket to make the compaction force closer to a preset target compaction force (specifically, raising the position of the bucket to lower the compaction force of the excavation surface or lowering position of the bucket to raise the compaction force) to thereby perform a control of making the actual compaction force closer to a target compaction force.

The apparatus described in Patent Literature 1 performs the control with regarding the cylinder thrust corresponding to the load of the boom cylinder as the compaction force, i.e., a pressing force by which the bucket is pressed against the construction surface; the pressing force, however, is changed also by the posture of the work device, thus not absolutely corresponding to the cylinder thrust. This hinders the apparatus from accurately grasping the pressing force by which the bucket is actually pressed against the construction surface and from performing precise control of the pressing force.

CITATION LIST

Patent Literature

Patent Literature 1: Japanese Unexamined Patent Publication No. 9-228404

SUMMARY OF INVENTION

It is an object of the present invention to provide a hydraulic drive apparatus provided in a work machine equipped with a work device including a boom, an arm, and a bucket, the hydraulic drive apparatus being capable of performing a control of making a construction surface by the bucket closer to a target construction surface and making a pressing force by which the bucket is pressed against the construction surface closer to a target pressing force with high accuracy.

Provided is a hydraulic drive apparatus provided in a work machine equipped with a machine body and a work device attached thereto, the work device including a boom supported on the machine body so as to be raiseable and lowerable, an arm connected to a distal end of the boom so as to be rotationally movable, and a bucket attached to the distal end of the arm to be pressed against a construction surface, to hydraulically drive the boom, the arm, and the bucket. The hydraulic drive apparatus includes: a hydraulic oil supply device including at least one hydraulic pump that is driven by a driving source to thereby discharge hydraulic oil; at least one boom cylinder that is expanded and contracted by supply of hydraulic oil from the hydraulic oil supply device to thereby raise and lower the boom; an arm cylinder that is expanded and contracted by supply of hydraulic fluid from the hydraulic oil supply device to thereby rotationally move the arm; a bucket cylinder that is expanded and contracted by supply of hydraulic fluid from the hydraulic fluid supply device to thereby rotationally move the bucket; a boom flow rate control valve interposed between the hydraulic oil supply device and the at least one boom cylinder and being capable of performing opening and closing motions so as to change a boom cylinder supply flow rate which is a flow rate of hydraulic oil supplied from the hydraulic oil supply device to the at least one boom cylinder and so as to change a boom cylinder discharge flow rate which is a flow rate of hydraulic oil discharged from the boom cylinder; a target construction surface setting part that sets a target construction surface defining a target shape of a construction object by the bucket; a working posture detection part that detects posture information which is information for determining a posture of the work device; a boom cylinder pressure detector that detects a head pressure and a rod pressure which are respective pressures of a head-side chamber and a rod-side chamber of the at least one boom cylinder; a cylinder speed calculation part that calculates cylinder speeds, which are respective operation speeds of the boom cylinder, the arm cylinder and the bucket cylinder, based on the posture information detected by the working posture detection part; a target boom cylinder speed calculation part that calculates a target boom cylinder speed which is a target value of the operation speed of the boom cylinder for making a surface to be constructed by the bucket along with a movement of the arm caused by expansion and contraction of the arm cylinder closer to the target construction surface, based on the respective cylinder speeds calculated by the cylinder speed calculation part; a boom flow rate operation part that operates the boom flow rate control valve to provide the target boom cylinder speed; a target pressing force setting part that sets a target pressing force which is a target value of a pressing force for pressing the bucket against the construction surface; a center-of-gravity position information calculation part that calculates center-of-gravity position information, which is information on a center-of-gravity position of the work device, based on the posture information detected by the working posture detection part; a pressing force calculation part that calculates a pressing force by which the bucket is pressed against the construction surface, based on a load due to a self-weight of the work device determined by the center-of-gravity position information and a cylinder thrust of the boom cylinder determined by the head pressure and the rod pressure detected by the boom cylinder pressure detector; and a correction part that corrects the target boom cylinder speed to be calculated by the target boom cylinder speed calculation part in a direction to make a deviation between the target pressing force and the calculated pressing force closer to 0. The boom flow rate operation part is configured to operate the boom flow rate control valve to provide the target boom cylinder speed corrected by the correction part.

DESCRIPTION OF EMBODIMENTS

There will be described a preferred embodiment of the invention with reference to the drawings.

Figure 1:
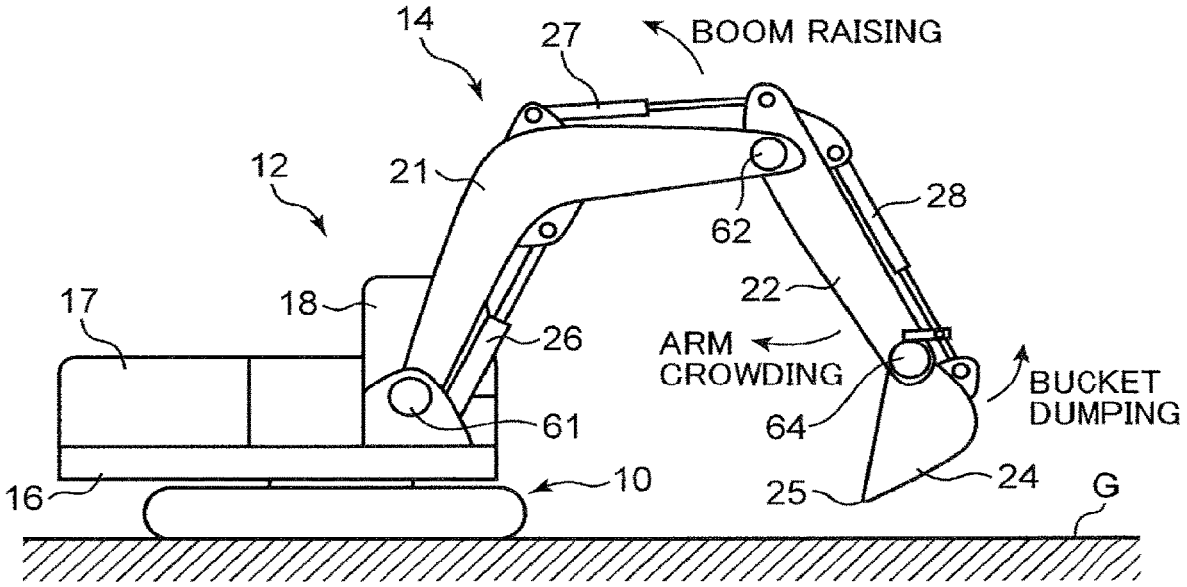
FIG. 1 is a side view showing a hydraulic excavator which is an example of a work device in which the hydraulic drive apparatus according to the embodiment of the present invention is installed.

FIG. 1 shows a hydraulic excavator which is an example of a work device in which a hydraulic drive apparatus according to an embodiment of the present invention is installed. The hydraulic excavator includes a lower traveling body 10 capable of traveling on the ground G, an upper turning body 12 mounted on the lower traveling body 10, and a work device 14 mounted on the upper turning body 12.

The lower traveling body 10 and the upper turning body 12 constitute a machine body that supports the work device 14. The upper turning body 12 includes a turning frame 16 and a plurality of elements mounted thereon. The plurality of elements include an engine room 17 for accommodating an engine and a cab 18 which is an operation room.

The work device 14 is capable of performing motions for excavation work and other necessary work, including a boom 21, an arm 22, and a bucket 24. The boom 21 has a proximal end and a distal end opposite to the distal end. The proximal end is supported on the front end of the turning frame 16 so as to be raiseable and lowerable, that is, movable rotationally about a horizontal axis. The arm 22 has a proximal end, which is attached to the distal end of the boom 21 movably rotationally about a horizontal axis, and a distal end opposite to the proximal end. The bucket 24 is attached to the distal end of the arm 22 so as to be rotationally movable.

The hydraulic drive apparatus is an apparatus for hydraulically driving the work device 14. The hydraulic drive apparatus includes a plurality of expandable and contractable hydraulic cylinders provided for the boom 21, the arm 22 and the bucket 24, respectively: namely, at least one boom cylinder 26, an arm cylinder 27 and a bucket cylinder 28.

The at least one boom cylinder 26 is interposed between the upper turning body 12 and the boom 21, and expanded and contracted so as to make the boom 21 perform rising and falling motions. The boom cylinder 26 has a head-side chamber **26*h* and a rod-side chamber 26*r* shown in FIG. 2. The boom cylinder 26 is expanded by supply of hydraulic oil to the head-side chamber 26*h* to actuate the boom 21 in a boom raising direction while discharging hydraulic oil from the rod-side chamber 26*r*. On the other hand, the boom cylinder 26 is contracted by supply of hydraulic oil to the rod-side chamber 26*r* to actuate the boom 21 in a boom lowering direction while discharging hydraulic oil from the head-side chamber 26*h***.

The at least one boom cylinder 26 may include only a single boom cylinder; this embodiment, however, includes a pair of boom cylinders 26 arranged laterally in parallel to each other.

The arm cylinder 27 is an arm actuator interposed between the boom 21 and the arm 22 and configured to be expanded and contracted to make the arm 22 perform a rotational movement. Specifically, the arm cylinder 27 has a head-side chamber **27*h* and a rod-side chamber 27*r* shown in FIG. 2. The arm cylinder 27 is expanded by supply of hydraulic oil to the head-side chamber 27*h* to actuate the arm 22 in an arm crowding direction, in which the distal end of the arm 22 approach the boom 21, while discharging hydraulic oil from the rod-side chamber 27*r*. On the other hand, the arm cylinder 27 is contracted by supply of hydraulic oil to the rod-side chamber 27*r* to actuate the arm 22 in an arm pushing direction, in which the distal end of the arm 22 goes away from the boom 21, while discharging hydraulic oil from the head-side chamber 27*h***.

The bucket cylinder 28 is interposed between the arm 22 and the bucket 24 and expanded and contracted so as to make the bucket 24 perform a rotational motion. Specifically, the bucket cylinder 28 is expanded to thereby actuate the bucket 24 rotationally in a crowding direction, in which the tip 25 of the bucket 24 approaches the arm 22, and contracted to thereby actuate the bucket 24 in a dumping direction, in which the tip 25 of the bucket 24 goes away from the arm 22.

Figure 2:
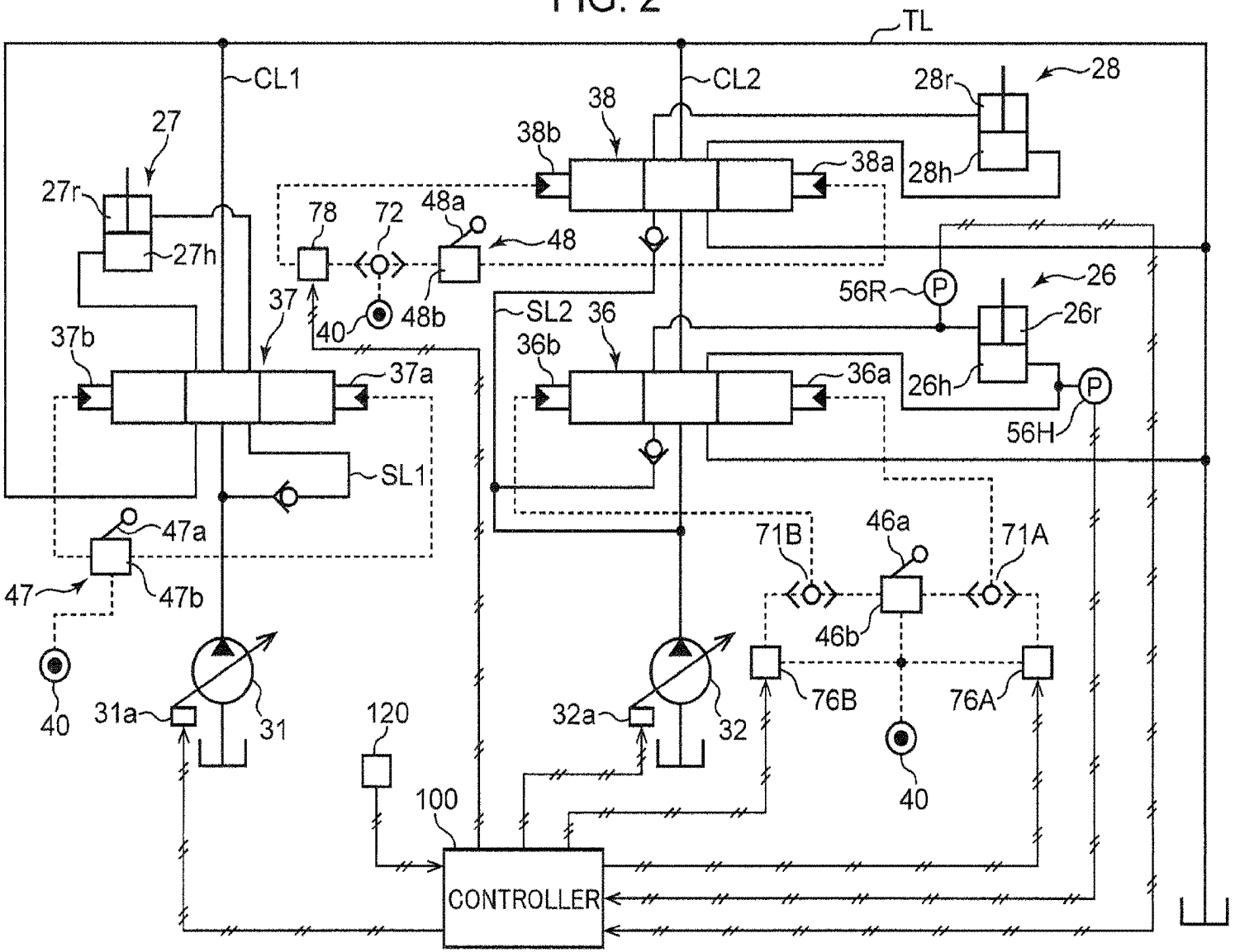
FIG. 2 is a diagram showing a hydraulic circuit and a controller that include components of a hydraulic drive apparatus installed on the hydraulic excavator.

FIG. 2 is a diagram showing a hydraulic circuit installed in the hydraulic excavator and a controller 100 electrically connected thereto, containing elements constituting the hydraulic drive apparatus. The controller **100*h*** is formed of, for example, a microcomputer, to control respective operations of the elements included in the hydraulic circuit.

The hydraulic circuit includes, in addition to the cylinders 26 to 28, a hydraulic oil supply device including a first hydraulic pump 31 and a second hydraulic pump 32, a boom flow rate control valve 36, an arm flow rate control valve 37, a bucket flow rate control valve 38, a pilot hydraulic pressure source 40, a boom operation device 46, an arm operation device 47, and a bucket operation device 48.

The first hydraulic pump 31 and the second hydraulic pump 32 are connected to a not-graphically-shown engine as a driving source, and driven by the power output by the engine to discharge hydraulic oil. Each of the first and second hydraulic pumps 31 and 32 is a variable displacement pump. Specifically, the first and second hydraulic pumps 31 and 32 have respective capacity operation valves 31*a* and 32*a*, and respective capacities of the first and second hydraulic pumps 31 and 32 are operated by respective pump capacity commands that are input from the controller 100 to the capacity operation valves 31*a* and 32*a*, respectively.

The boom flow rate control valve 36 is interposed between the second hydraulic pump 32 and the boom cylinder 26, and performs opening and closing motions to change a boom flow rate, which is the flow rate of hydraulic oil supplied from the second hydraulic pump 32 to the boom cylinder 26, and the flow rate of hydraulic oil discharged from the boom cylinder 26 to a tank. Specifically, the boom flow rate control valve 36 is formed of a pilot operated three-position direction selector valve having a boom raising pilot port 36*a* and a boom lowering pilot port 36*b*, and disposed in a second center bypass line CL2 that is connected to the second hydraulic pump 32.

The boom flow rate control valve 36 includes a not-graphically-shown sleeve and a spool inserted into the sleeve while allowed to stroke. The spool is held in a neutral position with no pilot pressure input to any of the boom raising and boom lowering pilot ports 36*a* and 36*b*, opening the second center bypass line CL2 and blocking the communication between the second hydraulic pump 32 and the boom cylinder 26 to thereby keep the boom cylinder 26 stopped.

By input of a boom raising pilot pressure to the boom raising pilot port 36*a*, the spool of the boom flow rate control valve 36 is shifted from the neutral position to a boom raising position by a stroke corresponding to the magnitude of the boom raising pilot pressure. This causes the boom flow rate control valve 36 to be opened so as to form an opening that allows hydraulic oil to be supplied from the second hydraulic pump 32 to the head-side chamber 26*h* of the boom cylinder 26 through the second supply line SL2 branched off from the second center bypass line CL2 at the flow rate corresponding to the stroke, namely, a boom raising flow rate, and so as to form an opening that allows hydraulic oil to return to the tank from the rod-side chamber 26*r* of the boom cylinder 26. The boom cylinder 26 is thereby driven in a boom raising direction, that is, in the expansion direction in this embodiment.

By input of the boom lowering pilot pressure to the boom lowering pilot port 36*b*, conversely, the boom flow rate control valve 36 is shifted from the neutral position to a boom lowering position by a stroke corresponding to the magnitude of the boom lowering pilot pressure, opening so as to form an opening that allows hydraulic oil to be supplied to the rod-side chamber 26*r* of the boom cylinders 26 through the second supply line SL2 from the second hydraulic pump 32 at a flow rate corresponding to the stroke, namely, a boom lowering flow rate, and so as to form an opening that allows hydraulic oil to return to the tank from the head-side chamber 26*h* of the boom cylinders 26. The boom cylinder 26 is thereby driven in the boom lowering direction, that is, in the contraction direction in this embodiment.

In other words, the boom flow rate control valve 36 simultaneously forms a head-side opening and a rod-side opening that are communicated with respective head-side chambers 26*h* and respective rod-side chambers 26*r* of the pair of boom cylinders 26, at the boom raising position and the boom lowering position, respectively, and changes their respective throttle opening areas (throttle opening degrees), which are respective areas of the openings (throttle openings), in accordance with the stroke of the spool corresponding to the boom raising and boom lowering pilot pressures.

The arm flow rate control valve 37 is interposed between the first hydraulic pump 31 and the arm cylinder 27, and performs opening and closing motions so as to change an arm flow rate which is the flow rate of hydraulic oil supplied from the first hydraulic pump 31 to the arm cylinder 27. Specifically, the arm flow rate control valve 37 is formed of a pilot operated three-position direction selector valve having an arm crowding pilot port 37*a* and an arm pushing pilot port 37*b*, disposed in the first center bypass line CL1 that is connected to the first hydraulic pump 31.

The arm flow rate control valve 37 includes a not-graphically-shown sleeve and a spool loaded to the sleeve while allowed to stroke. The spool is set to a neutral position with no pilot pressure input to any of the arm crowding and arm pushing pilot ports 37*a* and 37*b*, opening the first center bypass line CL1 and blocking the communication between the first hydraulic pump 31 and the arm cylinder 27. The arm cylinder 27 is thereby kept stopped.

By input of the arm crowding pilot pressure to the arm crowding pilot port 37*a*, the spool of the arm flow rate control valve 37 is shifted from the neutral position to an arm crowding position by a stroke corresponding to the magnitude of the arm crowding pilot pressure. This causes the arm flow rate control valve 37 to be opened so as to allow hydraulic oil to be supplied to the head-side chamber 27*h* of the arm cylinder 27 from the first hydraulic pump 31 through the first supply line SL1 branched off from the first center bypass line CL1 at the flow rate corresponding to the stroke, namely, an arm crowding flow rate, and so as to allow hydraulic oil to return to the tank from the rod-side chamber 27*r* of the arm cylinder 27. This valve opening causes the arm cylinder 27 to be driven in the arm crowding direction at a speed corresponding to the arm crowding pilot pressure.

By input of the arm pushing pilot pressure to the arm pushing pilot port 37*b*, conversely, the arm flow rate control valve 37 is shifted from the neutral position to an arm pushing position by a stroke corresponding to the magnitude of the arm pushing pilot pressure, opening so as to allow hydraulic oil to be supplied to the rod-side chamber 27*r* of the arm cylinder 27 from the first hydraulic pump 31 through the first supply line SL1 at a flow rate corresponding to the stroke, namely, an arm pushing flow rate, and so as to allow hydraulic oil to return to the tank from the head-side chamber 27*h* of the arm cylinder 27. The arm cylinder 27 is thereby driven in the arm pushing direction at a speed corresponding to the arm pushing pilot pressure.

The bucket flow rate control valve 38 is disposed in parallel with the boom flow rate control valve 36 and interposed between the second hydraulic pump 32 and the bucket cylinder 28, performing opening and closing motions so as to change a bucket flow rate that is the flow rate of hydraulic fluid supplied from the second hydraulic pump 32 to the bucket cylinder 28. Specifically, the bucket flow rate control valve 38 is formed of a pilot operated three-position direction selector valve having a bucket crowding pilot port 38*a* and a bucket dumping pilot port 38*b*, disposed in the second center bypass line CL2 that is connected to the second hydraulic pump 32.

The bucket flow rate control valve 38 includes a not-graphically-shown sleeve and a spool loaded to the sleeve while allowed to stroke. The spool is set to a neutral position with no pilot pressure input to any of the bucket crowding and bucket crowding pilot ports 38*a* and 38*b*, opening the second center bypass line CL2 and blocking the communication between the second hydraulic pump 32 and the bucket cylinder 28. The bucket cylinder 28 is thereby kept stopped.

By input of the bucket crowding pilot pressure to the bucket crowding pilot port 38*a*, the spool of the bucket flow rate control valve 38 is shifted from the neutral position to a bucket crowding position by a stroke corresponding to the magnitude of the bucket crowding pilot pressure. This causes the bucket flow rate control valve 38 to be opened so as to allow hydraulic oil to be supplied to the head-side chamber 28*h* of the bucket cylinder 28 from the second hydraulic pump 32 through the second supply e SL2 at a flow rate corresponding to the stroke, namely, a bucket crowding flow rate, and so as to allow hydraulic oil to return to the tank from the rod-side chamber 28*r* of the bucket cylinder 28. This valve opening causes the bucket cylinder 28 to be driven in the bucket crowding direction at a speed corresponding to the bucket crowding pilot pressure.

By input of the bucket dumping pilot pressure to the bucket dumping pilot port 38*b*, conversely, the bucket flow rate control valve 38 is shifted from the neutral position to a bucket dumping position by a stroke corresponding to the magnitude of the bucket dumping pilot pressure, opening so as to allow hydraulic oil to be supplied to the rod-side chamber 28*r* of the bucket cylinder 28 from the second hydraulic pump 32 through the second supply line SL2 at a flow rate corresponding to the stroke, namely, a bucket dumping flow rate, and so as to allow hydraulic oil to return to the tank from the head-side chamber 28*h* of the bucket cylinder 28. The bucket cylinder 28 is thereby driven in the bucket dumping direction at a speed corresponding to the bucket dumping pilot pressure.

The boom operation device 46 receives a boom operation for moving the boom 21, allowing the boom raising pilot pressure or the boom lowering pilot pressure corresponding to the boom operation to be input to the boom flow rate control valve 36. Specifically, the boom operation device 46 includes a boom lever 46*a* allowing a rotational operation corresponding to the boom operation to be applied to the boom lever 46*a* in the operation room, and a boom pilot valve 46*b* coupled to the boom lever 46*a*.

The boom pilot valve 46*b* is interposed between both the pilot ports 36*a* and 36*b* of the boom flow rate control valve 36 and the pilot hydraulic pressure source 40. The boom pilot valve 46*b* is opened in conjunction with the boom operation applied to the boom lever 46*a* so as to allow the boom raising pilot pressure or the boom lowering pilot pressure having a magnitude corresponding to the magnitude of the boom operation to be input from the pilot hydraulic pressure source 40 to the pilot port corresponding to the direction of the boom operation out of both the pilot ports. For example, by the application of the boom operation to the boom lever 46*a* in a direction corresponding to the boom raising motion, the boom pilot valve 46*b* is opened so as to allow the boom raising pilot pressure corresponding to the magnitude of the boom operation to be supplied to the boom raising pilot port 36*a*.

The arm operation device 47 receives an arm operation for moving the arm 22, allowing the arm crowding pilot pressure or the arm pushing pilot pressure corresponding to the arm operation to be input to the arm flow rate control valve 37. Specifically, the arm operation device 47 includes an arm lever 47*a* allowing a rotational operation corresponding to the arm operation to be applied to the arm lever 47*a* in the operation room, and an arm pilot valve 47*b* coupled to the arm lever 47*a*.

The arm pilot valve 47*b* is interposed between both the pilot ports 37*a* and 37*b* of the arm flow rate control valve 37 and the pilot hydraulic pressure source 40. The arm pilot valve 47*b* is opened in conjunction with the arm operation applied to the arm lever 47*a*, so as to allow the arm crowding pilot pressure or the arm pushing pilot pressure having a magnitude corresponding to the magnitude of the arm operation to be input from the pilot hydraulic pressure source 40 to the pilot port corresponding to the direction of the arm operation out of both the pilot ports. For example, by the application of the arm operation in the direction corresponding to the arm crowding movement to the arm lever 47*a*, the arm pilot valve 47*b* is opened so as to allow the arm crowding pilot pressure corresponding to the magnitude of the arm operation to be supplied to the arm crowding pilot port 37*a*.

The bucket operation device 48 receives a bucket operation for moving the bucket 24, allowing a bucket crowding pilot pressure or a bucket dumping pilot pressure corresponding to the bucket operation to be input to the bucket flow rate control valve 38. Specifically, the bucket operation device 48 includes a bucket lever 48*a* allowing a rotational operation corresponding to the bucket operation to be applied to the bucket lever 48*a* in the operation room, and a bucket pilot valve 48*b* coupled to the bucket lever 48*a*.

The bucket pilot valve 48*b* is interposed between both the pilot ports 38*a* and 38*h* of the bucket flow rate control valve 38 and the pilot hydraulic pressure source 40. The bucket pilot valve 48*b* opens in conjunction with the bucket operation applied to the bucket lever 48*a*, so as to allow the bucket crowding pilot pressure or the bucket dumping pilot pressure having a magnitude corresponding to the magnitude of the bucket operation to be input from the pilot hydraulic pressure source 40 to the pilot port corresponding to the direction of the bucket operation out of both the pilot ports. For example, by application of the bucket operation in a direction corresponding to the bucket crowding operation to the bucket lever 48*a*, the bucket pilot valve 48*b* is opened so as to allow the bucket crowding pilot pressure corresponding to the magnitude of the bucket operation to be supplied to the bucket crowding pilot port 38*a*.

Figure 3:
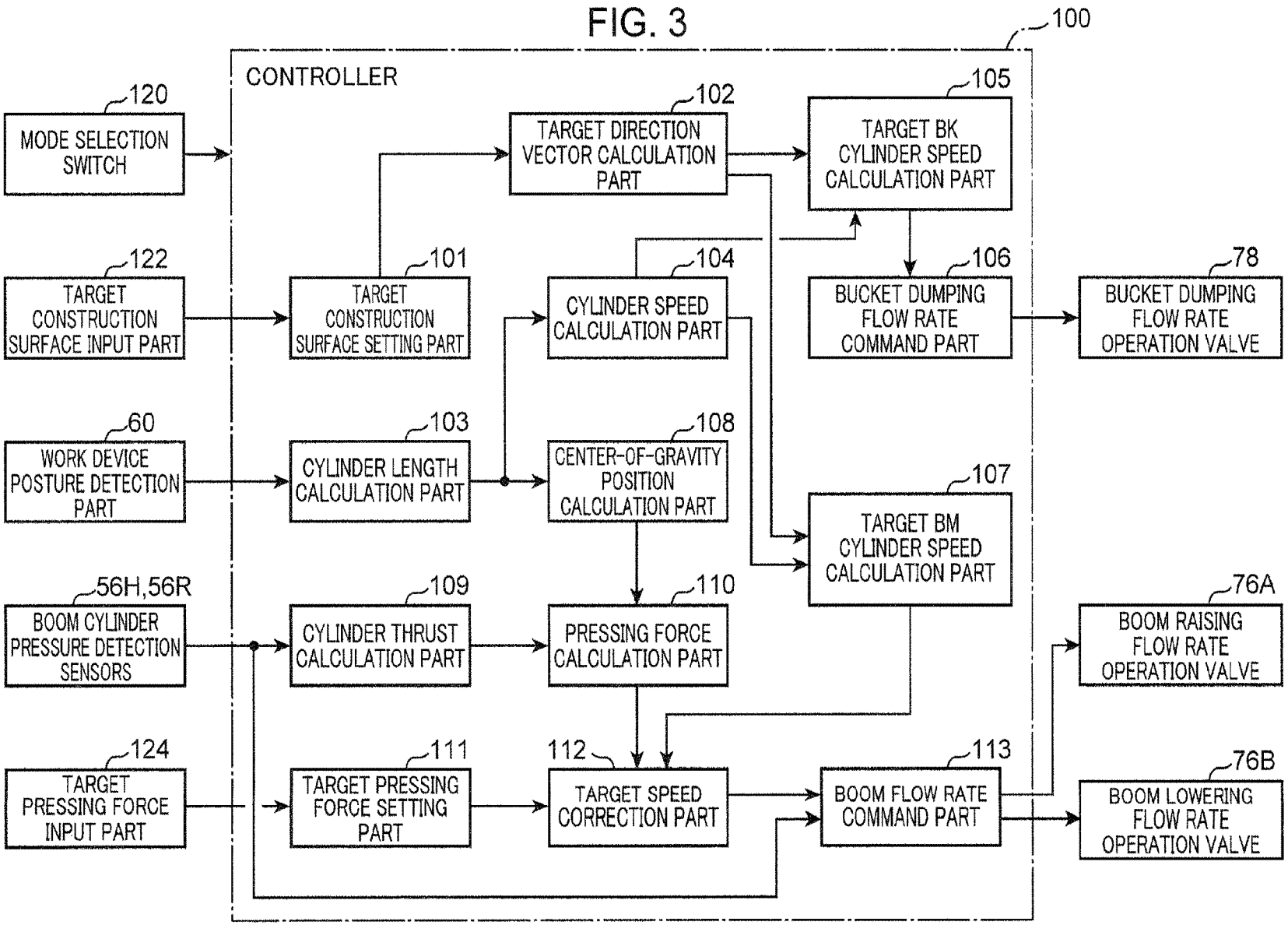
FIG. 3 is a block diagram showing the main functions of the controller included in the hydraulic drive apparatus.

The hydraulic drive apparatus further includes a boom cylinder head pressure sensor 56H, a boom cylinder rod pressure sensor 56R, a work device posture detection part 60 shown in FIG. 3, and a mode selection switch 120.

The boom cylinder head pressure sensor 56H and the boom cylinder rod pressure sensor 56R constitute a boom cylinder pressure detector. Specifically, the boom cylinder head pressure sensor 56H detects a boom cylinder head pressure Ph which is the pressure of hydraulic oil in the head-side chamber 26*h* of the boom cylinder 26, and the boom cylinder rod pressure sensor 56R detects a boom cylinder rod pressure Pr which is the pressure of hydraulic oil in the rod-side chamber 26*r* of the boom cylinder 26. Each of the sensors 56H and 56R converts the detected physical quantity into a detection signal which is an electrical signal corresponding thereto, inputting the detection signal to the controller 100.

The work device posture detection part 60 detects posture information which is information for determining the posture of the work device 14. Specifically, the work device posture detection part 60 includes a boom angle sensor 61, an arm angle sensor 62 and a bucket angle sensor 64, as shown in FIG. 1. The boom angle sensor 61 detects a boom angle which is an angle by which the boom 21 is raised relatively to the machine body; the arm angle sensor 62 detects an arm angle which is an angle of the rotational movement of the arm 22 relative to the boom 21; the bucket angle sensor 64 detects a bucket angle which is an angle of the rotational movement of the bucket 24 relative to the arm 22. Respective electrical signals generated by the sensors 61, 62 and 64, namely, angle detection signals, are also input to the controller 100.

The mode selection switch 120 is disposed in the operation room and electrically connected to the controller 100. The mode selection switch 120 receives an operation applied by an operator for selecting the control mode of the controller 100 between a manual operation mode and an automatic control mode, and inputs a mode command signal corresponding to the applied operation to the controller 100.

The controller 100 is switched between the manual operation mode and the automatic control mode in accordance with the mode command signal that is input from the mode selection switch 120. In the manual operation mode, the controller 100 allows the boom flow rate control valve 36, the arm flow rate control valve 37, and the bucket flow rate control valve 38 to operate so as to change the boom flow rate, the arm flow rate, and the bucket flow rate in response to the boom operation, the arm operation, and the bucket operation, which are applied by the operator to the boom operation device 46, the arm operation device 47, and the bucket operation device 48, respectively. On the other hand, the controller 100 is configured to perform, in the automatic control mode, an automatic control of the action of the boom cylinder 26 (in this embodiment, respective operations of the boom cylinder 26 and the bucket cylinder 28) in accordance with the expansion and contraction of the arm cylinder 27 so as to make the construction surface formed by the bucket 24 along with e movement of the arm 22 corresponding to the arm operation closer to a target construction surface that is set in advance.

Specifically, as shown in FIG. 2, the hydraulic drive apparatus further includes a boom raising flow rate operation valve 76A, a boom lowering flow rate operation valve 76B, a bucket dumping flow rate operation valve 78, shuttle valves 71A and 71B, and a shuttle valve 72, as means for enabling the boom cylinder 26 and the bucket cylinder 28 to be automatically controlled by the controller 100.

The boom raising flow rate operation valve 76A is interposed between the pilot hydraulic pressure source 40 and the boom raising pilot port 36*a*, in parallel with the boom operation device 46, to reduce the pilot pressure to be input from the pilot hydraulic pressure source 40 to the boom raising pilot port 36*a* in response to a boom flow rate command signal that is input from the controller 100, independently of the boom operation device 46. The boom raising flow rate operation valve 76A thus enables the controller 100 to automatically operate the pilot pressure to be input to the boom raising pilot port 36*a*, through the boom raising flow rate operation valve 76A. The shuttle valve 71A is interposed between each of the boom operation device 46 and the boom raising flow rate operation valve 76A and the boom raising pilot port 36*a*, and opened so as to allow a higher secondary pressure to be finally input to the boom raising pilot port 36*a* as the boom raising pilot pressure, the higher secondary pressure being higher than the other secondary pressure out of the secondary pressure of the boom operation device 46 and the secondary pressure of the boom raising flow rate operation valve 76A.

Similarly, the boom lowering flow rate operation valve 76B is interposed between the pilot hydraulic pressure source 40 and the boom lowering pilot port 36*b*, in parallel with the boom operation device 46, to reduce the pilot pressure to be input from the pilot hydraulic pressure source 40 to the boom lowering pilot port 36*b* in response to the boom flow rate command signal input from the controller 100, independently of the boom operation device 46. The boom lowering flow rate operation valve 76B thus allows the controller 100 to automatically operate the pilot pressure to be input to the boom lowering pilot port 36*b*, through the boom lowering flow rate operation valve 76B. The shuttle valve 71B is interposed between each of the boom operation device 46 and the boom lowering flow rate operation valve 76B and the boom lowering pilot port 36*b*, and opened so as to allow a higher secondary pressure to be finally input to the boom lowering pilot port 36*b* as the boom lowering pilot pressure, the higher secondary pressure being higher than the other secondary pressure out of the secondary pressure of the boom operation device 46 and the secondary pressure of the boom lowering flow rate operation valve 76B.

The bucket dumping flow rate operation valve 78 is interposed between the pilot hydraulic pressure source 40 and the bucket dumping pilot port 38*b*, in parallel with the bucket operation device 48, to reduce the pilot pressure to be input from the pilot hydraulic pressure source 40 to the bucket dumping pilot port 38*b* in response to a bucket dumping flow rate command signal input from the controller 100, independently of the bucket operation device 48. The bucket dumping flow rate operation valve 78 thus allows the controller 100 to automatically operate the pilot pressure to be input to the bucket dumping pilot port 38*b*, through the bucket dumping flow rate control valve 78. The shuttle valve 72 is interposed between each of the bucket operation device 48 and the bucket dumping flow rate operation valve 78 and the bucket dumping pilot port 38*b* and opened so as to allow a higher secondary pressure to be finally input to the bucket dumping pilot port 38*b* as the bucket dumping pilot pressure, the higher secondary pressure being higher the other secondary pressure out of the secondary pressure of the bucket operation device 48 and the secondary pressure of the bucket dumping flow rate operation valve 78.

Each of the flow rate operation valves 76A, 76B and 78 is formed of a solenoid valve (e.g., a solenoid proportional pressure-reducing valve or a solenoid inversely proportional pressure-reducing valve), which is configured to perform opening and closing motions so as to change the opening degree in response to the flow rate command signal input from the controller 100 to thereby generate a pilot pressure having a magnitude corresponding to the flow rate command.

In the manual operation mode, the controller 100 makes each of the flow rate operation valves 76A, 76B, and 78 substantially fully closed, thereby allowing the boom, arm and bucket flow rate control valves 36, 37 and 38 to be opened and closed in conjunction with respective operations applied to the boom, arm and bucket operation devices 46, 47 and 48, respectively. On the other hand, in the automatic control mode, the controller 100 inputs a flow rate command signal to each of the flow rate operation valves 76A, 76B, and 78, respectively, thereby executing an automatic control of making respective motions of the boom cylinder 26 and the bucket cylinder 28 follow the arm crowding motion of the arm 22 caused by the contraction motion of the arm cylinder 27.

Specifically, as shown in FIG. 3, the controller 100 includes, as functions for executing the automatic control, a target construction surface setting part 101, a target direction vector calculation part 102, a cylinder length calculation part 103, a cylinder speed calculation part 104, a target bucket cylinder speed calculation part 105, a bucket dumping flow rate command part 106, a target boom cylinder speed calculation part 107, a center-of-gravity position calculation part 108, a cylinder thrust calculation part 109, a pressing force calculation part 110, a target pressing force setting part 111, a target speed correction part 112, and a boom flow rate command part 113.

The target construction surface setting part 101 stores a construction surface that is input by the target construction surface input part 122 provided in the cab 18, and inputs the stored construction surface to the target direction vector calculation part 102 as a target construction surface. This target construction surface is a surface defining a target shape of the ground which is an object to be excavated, the shape being a three dimensional design ground shape. The target construction surface may be specified by external data such as CIM or may be set using the position of the machine body as a reference.

The target direction vector calculation part 102 calculates a target direction vector that defines a direction in which a specific portion of the bucket 24 is to be actuated to move the tip 25 of the bucket 24 along the target construction surface. The specific portion may be, for example, either the tip 25 or a portion connected to the distal end of the arm 22.

The cylinder length calculation part 103 calculates respective cylinder lengths of the boom cylinder 26, the arm cylinder 27, and the bucket cylinder 28, based on the posture information detected by the work device posture detection part 60. The cylinder speed calculation part 104 calculates cylinder speeds which are respective expansion and contraction speeds of the boom cylinder 26, the arm cylinder 27 and the bucket cylinder 28, through respective time differentiations of the cylinder lengths. The cylinder length calculation part 103 and the cylinder speed calculation part 104 according to this embodiment, thus, constitute a cylinder speed calculation part that calculates each of the cylinder speeds based on the posture information.

The target bucket cylinder speed calculation part 105 calculates a target bucket cylinder speed Vko based on the target direction vector and each of the cylinder speeds calculated by the cylinder speed calculation part 104. The target bucket cylinder speed Vko is a target value of the cylinder speed in the bucket dumping direction of the bucket cylinder 28 (in this embodiment, the speed in the contraction direction) for keeping the posture of the bucket 24 constant regardless of the movement of the arm 22 in the crowding direction, that is, for bringing the bucket 24 into parallel movement along the target construction surface.

The bucket dumping flow rate command part 106 calculates a target bucket dumping flow rate for providing the target bucket cylinder speed Vko, that is, the flow rate of hydraulic oil to be supplied to the rod-side chamber 28*r* of the bucket cylinder 28, and s a bucket dumping flow rate command signal for providing the target bucket dumping flow rate to input the generated signal to the bucket dumping flow rate operation valve 78. The bucket dumping flow rate operation valve 78 is opened at an opening degree corresponding to the bucket dumping flow rate command signal, thereby adjusting the pilot pressure to be input to the bucket dumping pilot port 38*b* of the bucket flow rate control valve 38 to a pilot pressure that provides the target bucket dumping flow rate.

The target boom cylinder speed calculation part 107 calculates a target boom cylinder speed Vbo based on the target direction vector and each of the cylinder speeds calculated by the cylinder speed calculation part 104. The target boom cylinder speed Vbo is a target value of the cylinder speed of the boom cylinder 26 in the boom raising direction (the speed in the expansion direction, in this embodiment) for making the construction surface, which is a surface formed by the bucket 24 along with the movement of the arm 22 in the crowding direction caused by the expansion of the arm cylinder 27, closer to the target construction surface, being a speed value corresponding to the cylinder speed (expansion speed) of the arm cylinder 27.

The target direction vector calculation part 102 and the target boom cylinder speed calculation part 107, thus, constitute a target boom cylinder speed calculation part according to the present invention. The calculation of the target bucket cylinder speed Vko is optional. For example, the target boom cylinder speed Vbo may be calculated on the premise that the bucket cylinder 28 is stationary, i.e., that the angle of the bucket 24 to the arm 22 is fixed. Such a case of no calculation of the target bucket cylinder speed Vko, that is, the case with omission of the automatic control of the bucket cylinder 28, requires none of the bucket dumping flow rate command part 106 and the bucket dumping flow rate operation valve 78.

The center-of-gravity position calculation part 108 constitutes a center-of-gravity position information calculation part that calculates center-of-gravity position information which is information on the center-of-gravity position of the work device 14 in cooperation with the cylinder length calculation part 103. Specifically, the center-of-gravity position calculation part 108, based on each of the cylinder lengths calculated by the cylinder length calculation part 103, calculates respective center-of-gravity positions of the boom 21, the arm 22 and the bucket 24, more specifically, using the center of the rotational movement of the boom 21 which is the pivot of the entire work device 14, namely, a boom foot, as a reference.

The cylinder thrust calculation part 109 and the pressing force calculation part 110 constitute a pressing force calculation part that calculates a pressing force Fp by which the bucket 24 is pressed against the construction surface.

The cylinder thrust calculation part 109 calculates the cylinder thrust Fct of the boom cylinder 26 based on the head pressure Ph and the rod pressure Pr detected by the boom cylinder head pressure sensor 56H and the boom cylinder rod pressure sensor 56R, respectively. The cylinder thrust Fct is represented by the following formula (1) when the thrust in the expansion direction of the boom cylinder 26 is positive.

$$Fct=Ph*Ah-Pr*Ar \quad (1)$$

In this formula, Ah is the cross-sectional area of the head-side chamber 26*h* of the boom cylinder 26, and Ar is the cross-sectional area of the rod-side chamber 26*r*, wherein the cross-sectional area Ar of the rod-side chamber 26*r* is generally smaller than the cross-sectional area Ah of the head-side chamber 26*h* by the cross-sectional area of the cylinder rod.

The pressing force calculation part 110 calculates a moment Mw of a downward load due to the self-weight of the work device 14 about the boom foot of the boom 21 as the pivot of the work device 14 and a moment Mct due to the cylinder thrust Fct, which is an upward moment when the cylinder thrust Fct is positive, based on the respective center-of-gravity positions of the boom 21, the arm 22, and the bucket 24 calculated by the center-of-gravity calculation part 108, and calculates the pressing force Fp by which the tip 25 of the bucket 24 is pressed against the construction surface, based on both the moments Mw and Mct.

The target pressing force setting part 111 stores the pressing force input by the target pressing force input part 124 provided in the cab 18 and inputs the pressing force to the target speed correction part 112 as a target pressing force Fpo. The value of the target pressing force Fpo may be, for example, either a value incorporated in a program in advance or a value input by an operator through an operation applied to a ten-key pad or the like in the target pressing force input part 124.

Alternatively, the target pressing force setting part 111 may store the pressing force Fp calculated by the pressing force calculation part 110 at the time when an operator applies an operation to a setting switch included in the target pressing force input part 124 in a state where the operator actually operates the work device 14 to press the bucket 24 against the ground, and set the pressing force Fp, as the target pressing force Fpo.

The target speed correction part 112 calculates a deviation ΔFp (=Fpo−Fp) between the target pressing force Fpo and the pressing force Fp calculated by the pressing force calculation part 110, and corrects the target boom cylinder speed Vbo calculated by the target boom cylinder speed calculation part 107 in a direction to make the deviation ΔFp closer to 0. In summary, the target speed correction part 112 performs such correction of the target boom cylinder speed Vbo as to make the pressing force Fp closer to the target pressing force Fpo.

The boom flow rate command part 113 constitutes a boom flow rate operation part in cooperation with the boom raising flow rate operation valve 76A and the boom lowering flow rate operation valve 76B. The boom flow rate operation part operates the boom flow rate control valve 36 to provide the target boom cylinder speed Vbo that has been corrected by the target speed correction part 112. Specifically, the boom flow rate command part 113 calculates a target boom raising flow rate or a target boom lowering flow rate for providing the corrected target boom cylinder speed Vbo, and generates a boom raising flow rate command signal for providing the target boom raising flow rate and inputs the signal to the boom raising flow rate operation valve 76A or generates a boom lowering flow rate command signal for providing the target boom lowering flow rate to input the signal to the boom lowering flow rate operation valve 76B.

Next will be described an arithmetic control operation performed by the controller 100 for driving the boom cylinder 26 in the automatic control mode and the action of the hydraulic drive apparatus involved by this with reference to the flowchart of FIG. 4.

Figure 4:
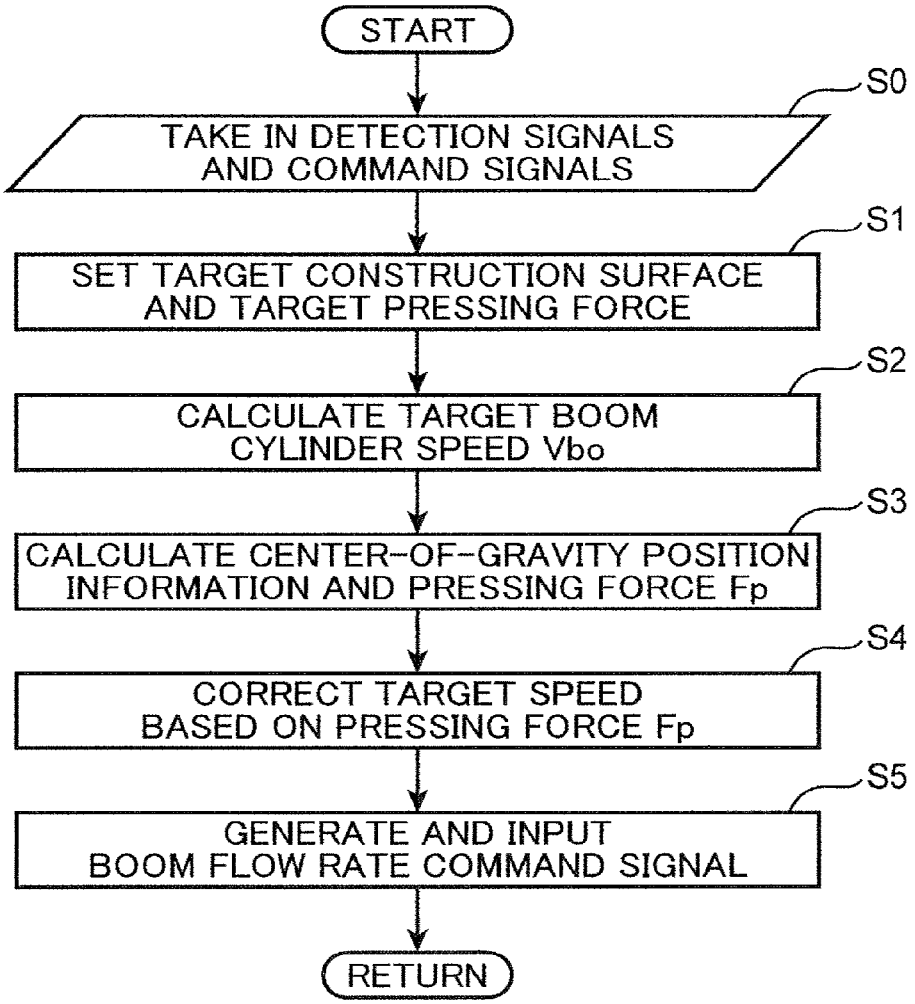
FIG. 4 is a flowchart showing an arithmetic control operation executed by the controller for driving the boom cylinder.

The controller 100 takes in the signals that are input to the controller 100, specifically the detection signals and the designation signals from the sensors (step S0 in FIG. 4). The designation signals include a signal on the target construction surface that is specified through the operation applied to the target construction surface input part 122 by the operator, and a signal on the target pressing force Fpo specified through the operation applied to the target pressing force input part 124. Based on the designation signals, the target construction surface setting part 101 and the target pressing force setting part 111 of the controller 100 perform the setting of the target construction surface and the target pressing force Fpo, respectively (step S1).

Next, the target boom cylinder speed calculation part 107 of the controller 100, based on the target construction surface and the actual cylinder speed calculated by the cylinder length calculation part 103 and the cylinder speed calculation part 104, calculates the target boom cylinder speed Vbo that corresponds to the cylinder speed of the arm cylinder 27 (step S2). The target boom cylinder speed Vbo is, as described above, the necessary speed of the boom cylinder 26 in the raising direction for interlocking the movement of the boom 21 in the raising direction with the movement of the arm 22 in the crowding direction so as to make the construction surface by the bucket 24 closer to the target construction surface. In other words, the target boom cylinder speed Vbo is the speed at which the boom cylinder 26 is to be moved to make a specific portion of the bucket 24 (e.g., the tip 25 of the bucket 24, or the proximal end portion supported by the distal end portion of the arm 22) move along the target construction surface in response to the operation applied to the arm lever 47*a* in the arm crowding direction by the operator.

Meanwhile, the center-of-gravity position information calculation part of the controller 100 calculates center-of-gravity position information on the work device 14, and the pressing force calculation part calculates the pressing force Fp by which the tip 25 of the bucket 24 is pressed against the construction surface (step S3). Specifically, the center-of-gravity position calculation part 108 calculates respective center-of-gravity positions of the boom 21, the arm 22 and the bucket 24 on the basis of the cylinder lengths calculated by the cylinder length calculation part 103. On the other hand, the cylinder thrust calculation part 109 calculates the cylinder thrust Fct (=Ph*Ah−Pr*Ar) of the boom cylinder 26 based on the head pressure Ph and the rod pressure Pr of the boom cylinder 26 which are detected by the boom cylinder head pressure sensor 56H and the boom cylinder rod pressure sensor 56R, respectively. Then, the pressing force calculation part 110 calculates the downward moment Mw around the boom foot due to the self-weight of the entire work device 14 and the upward moment Met around the boom foot due to the cylinder thrust Pet, based on the respective center-of-gravity positions, and calculates the pressing force Fp based on the difference between the moments Mw and Met.

The reaction force that the bucket 24 receives from the construction surface (including a slope face) and that corresponds to the pressing force Fp is indicated by a vector in the normal direction of the construction surface. When the force applied to the construction surface from the bucket 24 correspondingly to the moment around the boom foot, the force being perpendicular to the radial direction of the moment, is Fm, and the angle formed by the direction of the force Fm and the normal direction is θ, the pressing force Fp is expressed by the following formula (2).

$$Fp=Fm*\cos\theta \tag{2}$$

The target speed correction part 112 of the controller 100, furthermore, calculates the deviation ΔFp (=Fpo−Fp) between the target pressing force Fpo and the pressing force Fp, and performs correction of the target boom cylinder speed Vbo so as to make the deviation ΔFp closer to 0 (step S4). This correction is performed, for example, by subtracting a correction amount from the target boom cylinder speed Vbo, the correction amount obtained by multiplying the deviation ΔFp by a specific gain.

Next, the boom flow rate command part 113 of the controller 100 generates a boom raising flow rate command signal or a boom lowering command signal to provide the thus corrected target boom cylinder speed Vbo and inputs the signal to the boom raising flow rate operation valve 76A or the boom lowering flow rate operation valve 76B (step S5), thereby performing the control of the specific throttle opening of the boom flow rate control valve 36.

Specifically, the boom flow rate command part 113 inputs a flow rate command signal to the flow rate operation valve that operates the flow rate of hydraulic oil to be supplied to the boom cylinder 26 out of the boom raising flow rate operation valve 76A and the boom lowering flow rate operation valve 76B, thereby controlling the speed of the boom cylinder 26. For example, in the case where the direction of the target boom cylinder speed Vbo is the expansion direction, namely, the boom raising direction, the boom flow rate command part 113 generates a boom raising flow rate command signal corresponding to the target boom cylinder speed Vbo and inputs the signal to the boom raising flow rate operation valve 76A. In the case where the direction of the target boom cylinder speed Vbo is, conversely, a contraction direction, namely, the boom lowering direction, the boom flow rate command part 113 generates a boom lowering flow rate command signal corresponding to the target boom cylinder speed Vbo and inputs the signal to the boom raising flow rate operation valve 76A.

The boom flow rate command part 113, alternatively, may input the flow rate command signal to the flow rate operation valve that operates the flow rate of hydraulic oil to be discharged from the boom cylinder 26, depending on the relationship between the direction of the target boom cylinder speed Vbo and the direction of the cylinder thrust Fct. Specifically, in the case where the direction of the target boom cylinder speed Vbo and the direction of the cylinder thrust Fct are opposite, i.e., the case where the direction of the target boom cylinder speed Vbo is the expansion direction whereas the direction of the cylinder thrust Fct is the contraction direction, or the case where the direction of the target boom cylinder speed Vbo is the contraction direction whereas the direction of the cylinder thrust Fct is the expansion direction, the boom cylinder 26 is expanded and contracted against the cylinder thrust Fct and the holding pressure is, therefore, the pressure of the discharge side of the boom cylinder 26. In this case, it may be selected, accordingly, a flow control valve to be operated to control the flow rate of the discharge side, out of the boom raising flow rate operation valve 76A and the boom lowering flow rate operation valve 76B. More specifically, the boom flow rate command part 113 may perform such an arithmetic control operation as to input the boom lowering flow rate command signal to the boom lowering flow rate operation valve 76B when the target boom cylinder speed Vbo is in the expansion direction while the cylinder thrust Pet is in the contraction direction and as to input the boom raising flow rate command signal to the boom raising flow rate operation valve 76A when the target boom cylinder speed Vbo is in the contraction direction while the cylinder thrust Fct is in the expansion direction.

In the above-described apparatus, the pressing force Fp is calculated, in addition to the cylinder thrust Fct of the boom cylinder 26, in consideration with the load due to the self weight of the work device 14, based on the working posture information detected by the work device posture detection part 60 and further the center-of-gravity position information calculated by the center-of-gravity position information calculation part. Hence, the correction of the target boom cylinder speed Vbo to be calculated based on the deviation ΔFp of the pressing force Fp from the target pressing force Fpo enables the control for making the construction surface formed by the bucket 24 closer to the target construction surface and making the pressing force Fp closer to the target pressing force Fpo to be performed with high accuracy.

The present invention is not limited to the above-described embodiments. The present invention encompasses, for example, the following modes.

(1) Correction of Target Boom Cylinder Speed to be Calculated

In the present invention, the correction part "that corrects the target boom cylinder speed to be calculated by the target boom cylinder speed calculation part in a direction to make the deviation between the target pressing force and the calculated pressing force closer to 0" is not limited to one which corrects the target boom cylinder speed Vbo that has already been calculated by the target boom cylinder speed calculation part, such as the target speed correction part 112. The correction part may be also one that corrects the finally calculated target boom cylinder speed by correcting a parameter which is used for the calculation of the target boom cylinder speed that has not been calculated yet by the target boom cylinder speed calculation part.

Figure 5:
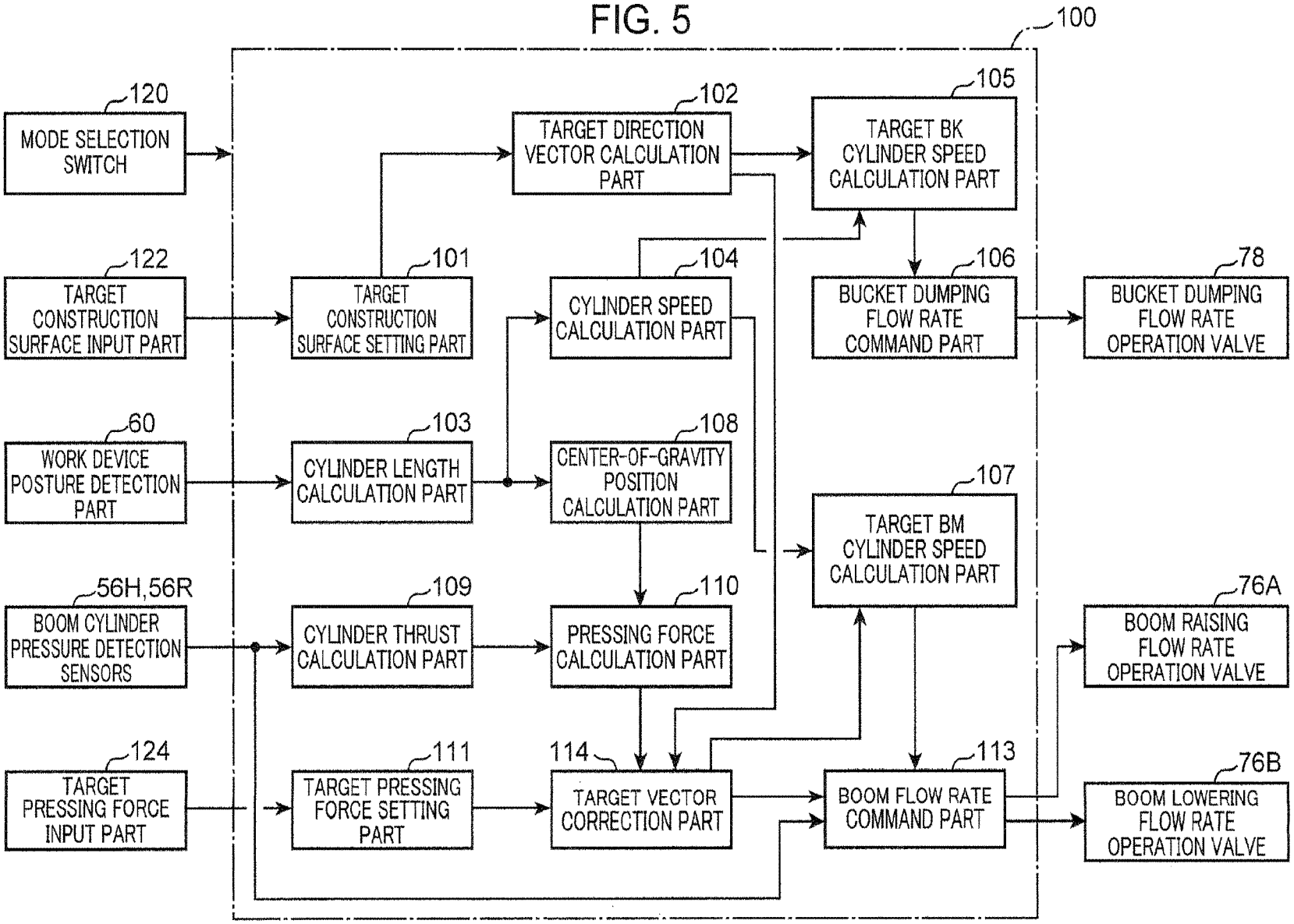
FIG. 5 is a block diagram showing a modification of the correction function of the target boom cylinder speed in the controller.

FIG. 5 shows the modification of the controller 100 including such a correction part. The controller 100 includes a target vector correction part 114 in place of the target speed correction part 112 shown in FIG. 3. The target vector correction part 114 corrects the target direction vector calculated by the target direction vector calculation part 102 in a direction to make the deviation ΔFp between the calculated pressing force Fp and the target pressing force Fpo closer to 0. The target boom cylinder speed calculation part 107 calculates the final target boom cylinder speed Vbo based on the corrected target vector and the cylinder speed calculated by the cylinder speed calculation part 104. The target vector correction part 114 according to this modification is also able to correct the target boom cylinder speed Vbo to be finally calculated.

(2) Boom Flow Rate control Valve

The specific configuration of the boom flow rate control valve according to the present invention is not limited. Although the boom flow rate control valve 36 according to the embodiment is formed of a pilot operated three-position direction selector valve that changes respective opening areas of both the head-side opening and the rod-side opening by the stroke of a single spool, the boom flow rate control valve according to the present invention may be, for example, a combination of a head-side flow rate control valve and a rod-side flow rate control valve that are connected to the head-side chamber and the rod-side chamber of the boom cylinder, respectively.

(3) Calculation of Target Boom Cylinder Speed

The method for calculation of the target boom cylinder speed is not limited to the calculation method in the above-described embodiment. The target boom cylinder speed, for example, may be determined correspondingly to the actual posture information, based on a map prepared in advance for the relationship between the posture information for determining the posture of the work device and the target boom cylinder speed.

(4) Direction of Arm Movement

Although the embodiment is intended to control the cylinder speed of the boom cylinder 26 in response to the movement of the arm 22 in the arm crowding direction, the present invention can be also applied to the control of the boom cylinder following movement of the arm in the arm pushing direction or reciprocating movements in the arm pushing direction and the arm crowding direction. For example, also when the control of the cylinder speed in the contraction direction of the boom cylinder is performed accompanying the movement of the arm in the pushing direction, the same effect as described above can be provided by selecting the flow rate to be controlled out of the boom raising flow rate and the boom lowering flow rate (supply-side flow rate or discharge-side flow rate) based on the direction of the target boom cylinder speed and the direction of the cylinder thrust.

EXAMPLE

Figure 6:
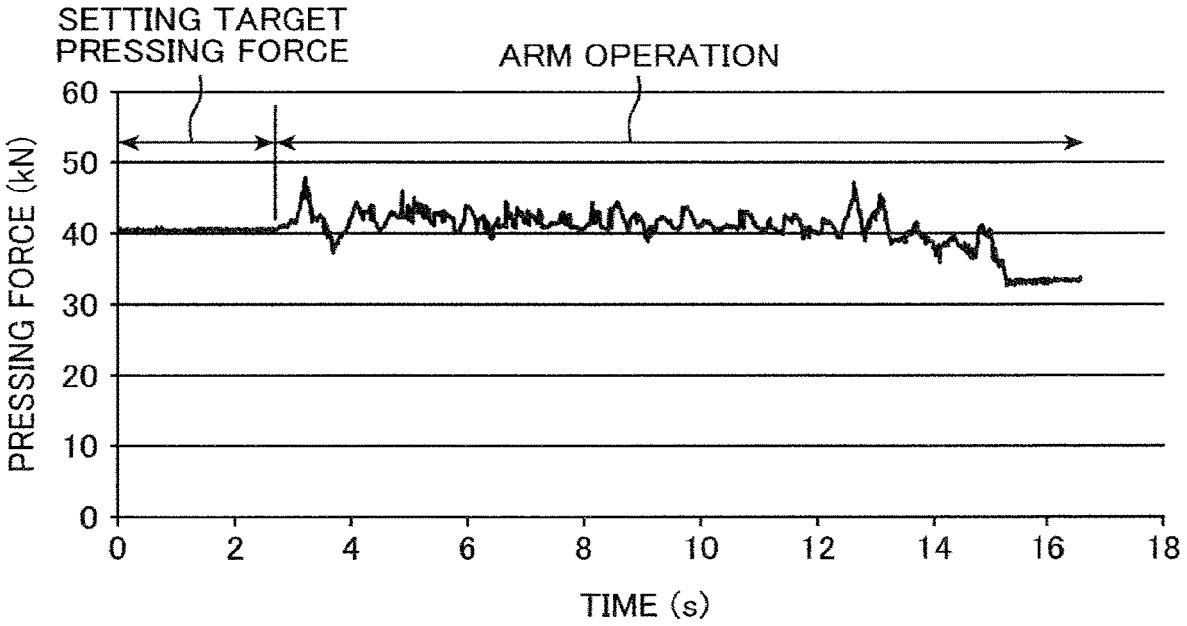
FIG. 6 is a graph showing an example of a pressing force controlled by the hydraulic drive apparatus according to the embodiment.

Experiments were conducted to measure the temporal change in the pressing force (kN), which actually occurs when the apparatus according to the embodiment is operated. FIG. 6 shows the results thereof. First, the work of pressing the back surface of the bucket 24 against the construction surface was performed through manual operation by an operator, and the pressing force Fp calculated by the pressing force calculation part at that time was set as the target pressing force Fpo. The speed control of the boom cylinder 26 was thereafter executed including the correction of making the deviation ΔFp between the calculated pressing force Fp and the target pressing force Fpo closer to 0, whereby the automatic control was achieved for making the construction surface formed by the bucket 24 closer to the target construction surface while keeping the value of the pressing force Fp close to the target pressing force Fpo.

As described above, according to the present invention, there can be provided a hydraulic drive apparatus provided in a work machine equipped with a work device including a boom, an arm, and a bucket to hydraulically actuate the work device, the hydraulic drive apparatus being capable of performing a control of making a construction surface by the bucket closer to a target construction surface and making a pressing force by which the bucket is pressed against the construction surface closer to the target pressing force with high accuracy.

Provided is a hydraulic drive apparatus provided in a work machine equipped with a machine body and a work device attached thereto, the work device including a boom supported on the machine body so as to be raiseable and lowerable, an arm connected to a distal end of the boom so as to be rotationally movable, and a bucket attached to the distal end of the arm to be pressed against a construction surface, to hydraulically drive the boom, the arm, and the bucket. The hydraulic drive apparatus includes: a hydraulic oil supply device including at least one hydraulic pump that is driven by a driving source to thereby discharge hydraulic oil; at least one boom cylinder that is expanded and contracted by supply of hydraulic oil from the hydraulic oil supply device to thereby raise and lower the boom; an arm cylinder that is expanded and contracted by supply of hydraulic fluid from the hydraulic oil supply device to thereby rotationally move the arm; a bucket cylinder that is expanded and contracted by supply of hydraulic fluid from the hydraulic fluid supply device to thereby rotationally move the bucket; a boom flow rate control valve interposed between the hydraulic oil supply device and the at least one boom cylinder and being capable of performing opening and closing motions so as to change a boom cylinder supply flow rate which is a flow rate of hydraulic oil supplied from the hydraulic oil supply device to the at least one boom cylinder and so as to change a boom cylinder discharge flow rate which is a flow rate of hydraulic oil discharged from the boom cylinder; a target construction surface setting part that sets a target construction surface defining a target shape of a construction object by the bucket; a working posture detection part that detects posture information which is information for determining a posture of the work device; a boom cylinder pressure detector that detects a head pressure and a rod pressure which are respective pressures of a head-side chamber and a rod-side chamber of the at least one boom cylinder; a cylinder speed calculation part that calculates cylinder speeds, which are respective operation speeds of the boom cylinder, the arm cylinder and the bucket cylinder, based on the posture information detected by the working posture detection part; a target boom cylinder speed calculation part that calculates a target boom cylinder speed which is a target value of the operation speed of the boom cylinder for making a surface to be constructed by the bucket along with a movement of the arm caused by expansion and contraction of the arm cylinder closer to the target construction surface, based on the respective cylinder speeds calculated by the cylinder speed calculation part; a boom flow rate operation part that operates the boom flow rate control valve to provide the target boom cylinder speed; a target pressing force setting part that sets a target pressing force which is a target value of a pressing force for pressing the bucket against the construction surface; a center-of-gravity position information calculation part that calculates center-of-gravity position information, which is information on a center-of-gravity position of the work device, based on the posture information detected by the working posture detection part; a pressing force calculation part that calculates a pressing force by which the bucket is pressed against the construction surface, based on a load due to a self-weight of the work device determined by the center-of-gravity position information and a cylinder thrust of the boom cylinder determined by the head pressure and the rod pressure detected by the boom cylinder pressure detector; and a correction part that corrects the target boom cylinder speed to be calculated by the target boom cylinder speed calculation part in a direction to make a deviation between the target pressing force and the calculated pressing force closer to 0. The boom flow rate operation part is configured to operate the boom flow rate control valve to provide the target boom cylinder speed corrected by the correction part.

In this apparatus, where the center-of-gravity position information calculation part calculates the center-of-gravity position information on the basis of the working posture information detected by the work device posture detection part and the pressing force calculation part calculates the pressing force in consideration with the load due to the self-weight of the work device determined by the position of the center of gravity, in addition to the cylinder thrust determined by the rod pressure and the rod pressure of the boom cylinder, the correction of the target boom cylinder speed to be calculated based on the deviation of the pressing force from the target pressing force enables a control to be executed with high accuracy for making the construction surface by the bucket closer to the target construction surface and making the pressing force closer to the target pressing force.

The correction part "that corrects the target boom cylinder speed to be calculated by the target boom cylinder speed calculation part in a direction to make the deviation between the target boom cylinder speed and the calculated pressing force closer to 0" may be either one that corrects the target boom cylinder speed that has already been calculated by the target boom cylinder speed calculation part or one that corrects a parameter used for calculating the target boom cylinder speed that has not been calculated yet by the target boom cylinder speed calculation part to thereby correct the target boom cylinder speed to be finally calculated. For example, in the case where the target boom cylinder speed calculation part includes a target direction vector calculation part that calculates a target direction vector defining a target direction in which a specific portion of the bucket is to be moved along the target construction surface, and a target boom cylinder speed calculation part that calculates the target boom cylinder speed based on the target direction vector and the cylinder speed of the boom cylinder, the correction part may be configured to correct the target direction vector calculated by the target direction vector calculation part in a direction to make the deviation closer to 0.

The boom flow rate control valve, for example, can be formed of a pilot operated direction selector valve having a boom raising pilot port and a boom lowering pilot port, configured to be opened at an opening degree corresponding to a magnitude of a boom raising pilot pressure input to the boom raising pilot port so as to make the boom cylinder operate in a direction to raise the boom and configured to be opened at an opening degree corresponding to a magnitude of a boom lowering pilot pressure input to the boom lowering pilot port so as to make the boom cylinder operate in a direction to lower the boom. In this case, the boom flow rate operation part preferably includes: a boom raising flow rate operation valve interposed between a pilot hydraulic pressure source and the boom raising pilot port and operated to open and close by input of a boom raising flow rate command signal so as to make the boom raising pilot pressure to be input to the boom raising pilot port be a pilot pressure having a magnitude corresponding to the boom raising flow rate command signal; a boom lowering flow rate operation valve interposed between the pilot hydraulic pressure source and the boom lowering pilot port and operated to open and close by input of a boom lowering flow rate command signal so as to make the boom lowering pilot pressure to be input to the boom lowering pilot port be a pilot pressure having a magnitude corresponding to the boom lowering flow rate command signal; and a boom flow rate command part that inputs a flow rate signal to the boom raising flow rate operation valve or the boom lowering flow rate operation valve to provide the target boom cylinder speed corrected by the correction part.

The target pressing force setting part may either store a value of the target pressing force incorporated in a program in advance and set the value, or store a value input through an input operation by an operator as a value of the target pressing force and set the value; meanwhile, it is preferable that the target pressing force setting part is configured to store the pressing force calculated by the pressing force calculation part when the bucket is pressed against a construction surface through a manual operation for the work device by an operator and set the pressing force, as the target pressing force. The thus configured target pressing force setting part allows an operator to set the pressing force determined to be preferable as the target pressing force by actually operating the work device.

The invention claimed is:

1. A hydraulic drive apparatus provided in a work machine equipped with a machine body and a work device attached to the machine body, the work device including a boom supported on the machine body so as to be raiseable and lowerable, an arm connected to a distal end of the boom so as to be rotationally movable, and a bucket attached to the distal end of the arm to be pressed against a construction surface, to hydraulically drive the boom, the arm, and the bucket, the hydraulic drive apparatus comprising:

a hydraulic oil supply device including at least one hydraulic pump that is driven by a driving source to thereby discharge hydraulic oil;

at least one boom cylinder that is expanded and contracted by supply of hydraulic fluid from the hydraulic fluid supply device to thereby raise and lower the boom;

an arm cylinder that is expanded and contracted by supply of hydraulic fluid from the hydraulic oil supply device to thereby rotationally move the arm;

a bucket cylinder that is expanded and contracted by supply of hydraulic fluid from the hydraulic fluid supply device to thereby rotationally move the bucket;

a boom flow rate control valve interposed between the hydraulic oil supply device and the at least one boom cylinder and being capable of performing opening and closing motions so as to change a boom cylinder supply flow rate which is a flow rate of hydraulic oil supplied from the hydraulic oil supply device to the at least one boom cylinder and so as to change a boom cylinder discharge flow rate which is a flow rate of hydraulic oil discharged from the boom cylinder;

a target construction surface setting part that sets a target construction surface defining a target shape of a construction object by the bucket;

a working posture detection part that detects posture information which is information for determining a posture of the work device;

a boom cylinder pressure detector that detects a head pressure and a rod pressure which are respective pressures of a head-side chamber and a rod-side chamber of the at least one boom cylinder;

a cylinder speed calculation part that calculates cylinder speeds, which are respective operation speeds of the boom cylinder, the arm cylinder and the bucket cylinder, based on the posture information detected by the working posture detection part;

a target boom cylinder speed calculation part that calculates a target boom cylinder speed which is a target value of the operation speed of the boom cylinder for making a surface to be constructed by the bucket along with a movement of the arm caused by expansion and contraction of the arm cylinder closer to the target construction surface, based on the respective cylinder speeds calculated by the cylinder speed calculation part;

a boom flow rate operation part that operates the boom flow rate control valve to provide the target boom cylinder speed;

a target pressing force setting part that sets a target pressing force which is a target value of a pressing force for pressing the bucket against the construction surface;

a center-of-gravity position information calculation part that calculates center-of-gravity position information which is information on a center-of-gravity position of the work device, based on the posture information detected by the working posture detection part;

a pressing force calculation part that calculates a pressing force by which the bucket is pressed against the construction surface, based on a load due to a self-weight of the work device determined by the center-of-gravity position information and a cylinder thrust of the boom cylinder determined by the head pressure and the rod pressure detected by the boom cylinder pressure detector; and a correction part that corrects the target boom cylinder speed to be calculated by the target boom cylinder speed calculation part in a direction to make a deviation between the target pressing force and the calculated pressing force closer to 0, wherein the boom flow rate operation part is configured to operate the boom flow rate control valve to provide the target boom cylinder speed corrected by the correction part.

2. The hydraulic drive apparatus according to claim 1, wherein the correction part is a target speed correction part that corrects the target boom cylinder speed that has already been calculated by the target boom cylinder speed calculation part.

3. The hydraulic drive apparatus according to claim 1, wherein the target boom cylinder speed calculation part includes a target direction vector calculation part that calculates a target direction vector defining a target direction in which a specific portion of the bucket is to be moved along the target construction surface, and a target boom cylinder speed calculation part that calculates the target boom cylinder speed based on the target direction vector and the cylinder speed of the boom cylinder, and the correction part is a target vector correction part that corrects the target direction vector calculated by the target direction vector calculation part in a direction to make the deviation closer to 0.

4. The hydraulic drive apparatus according to claim 1, wherein the boom flow rate control valve is a pilot operated direction selector valve having a boom raising pilot port and a boom lowering pilot port, configured to be opened at an opening degree corresponding to a magnitude of the boom raising pilot pressure input to the boom raising pilot port so as to operate the boom cylinder in a direction to raise the boom and configured to be opened at an opening degree corresponding to a magnitude of the boom lowering pilot pressure input to the boom lowering pilot port so as to operate the boom cylinder in a direction to lower the boom, and wherein the boom flow rate operation part includes: a boom raising flow rate operation valve interposed between a pilot hydraulic pressure source and the boom raising pilot port and operated to open and close by input of a boom raising flow rate command signal so as to make the boom raising pilot pressure to be input to the boom raising pilot port be a pilot pressure having a magnitude corresponding to the boom raising flow rate command signal; a boom lowering flow rate operation valve interposed between the pilot hydraulic pressure source and the boom lowering pilot port and operated to open and close by input of a boom lowering flow rate command signal so as to make the boom lowering pilot pressure to be input to the boom lowering pilot port be a pilot pressure having a magnitude corresponding to the boom lowering flow rate command signal; and a boom flow rate command part that inputs a flow rate signal to the boom raising flow rate operation valve or the boom lowering flow rate operation valve to provide the target boom cylinder speed corrected by the correction part.

5. The hydraulic drive apparatus according to claim 1, wherein the target pressing force setting part stores the pressing force calculated by the pressing force calculation part when the bucket is pressed against the construction surface through a manual operation for the work device by the operator and sets the pressing force, as the target pressing force.

* * * * *